252-99 40 106 Ex
11/11/80 XR 4,233,173

United States Patent [19]
Mayer et al.
[11] 4,233,173
[45] Nov. 11, 1980

[54] DETERGENT COMPOSITIONS CONTAINING DIPOTASSIUM N-CHLOROIMIDODISULFATE BLEACHING AGENT

[75] Inventors: James M. Mayer, Maryland Heights; John H. Payne, St. Louis, both of Mo.

[73] Assignee: Monsanto Company, St. Louis, Mo.

[21] Appl. No.: 959,394

[22] Filed: Nov. 9, 1978

[51] Int. Cl.[3] ..... C11D 7/54; D06L 3/00

[52] U.S. Cl. ..... 252/102; 252/98; 252/99; 252/539; 252/558

[58] Field of Search ..... 252/95, 99, 102; 423/386

[56] References Cited

U.S. PATENT DOCUMENTS

| | | | |
|---|---|---|---|
| 2,897,052 | 7/1959 | Teuber | 423/386 |
| 3,749,672 | 7/1973 | Golion et al. | 252/95 |
| 3,767,586 | 10/1973 | Rutkiewic | 252/187 H |
| 3,829,385 | 8/1974 | Abbott et al. | 252/95 |
| 4,086,177 | 4/1978 | Kubitscher et al. | 252/102 |
| 4,088,611 | 5/1978 | Suzuki et al. | 252/541 |
| 4,148,742 | 4/1979 | Crutchfield et al. | 252/102 |

FOREIGN PATENT DOCUMENTS 7119722 2/1971 Japan .

OTHER PUBLICATIONS

Raschig, R., "Potassium Chlorimidodisulfonate," Z. Anorg. Allgem. Chem., 147, pp. 1–4 (1925), (Translation).

*Primary Examiner*—P. E. Willis, Jr.
*Attorney, Agent, or Firm*—S. M. Tarter; E. P. Grattan; F. D. Shearin

[57] ABSTRACT

A substantially stable, crystalline dipotassium N-chloroimidodisulfate is useful as a bleach to remove stains from soiled fabrics when dissolved in an aqueous solution.

3 Claims, No Drawings

DETERGENT COMPOSITIONS CONTAINING DIPOTASSIUM N-CHLOROIMIDODISULFATE BLEACHING AGENT

BACKGROUND OF THE INVENTION

This invention relates to dipotassium chloroimidodisulfate, and is particularly directed to a substantially stable crystalline dipotassium N-chloroimidodisulfate.

Detergent compositions containing a water soluble detergent surfactant, and generally a builder which is used to sequester calcium and magnesium ions and to improve detergency levels of soaps and synthetic detergents, are widely used in home and industrial laundries for cleaning fabrics. Such detergent compositions may also contain fillers, such as sodium sulfate, and minor amounts of optical brighteners, soil antiredeposition agents, perfumes and the like. Although such detergent compositions effectively remove soil from fabrics, such as polyester, polyester/cotton, cotton and the like, certain stains on the fabric caused by tea, grape juice, red wine and the like, are very difficult to remove from fabrics using conventional detergent formulations.

To remove stains caused by tea, grape juice, red wine and the like, it is a common laundry practice to add a bleach to aid in the removal of such stains from the fabric. The most common bleaches are the peroxide-type bleaches and the hypochlorite-type bleaches, such as sodium perborate and sodium hypochlorite, respectively. However, each of these bleaches suffer from certain disadvantages. The peroxide-type bleaches usually require an activator to be effective and particularly in cold or tepid water. On the other hand, the hypochlorite bleaches can effectively remove the stain but such stain removal is frequently accompanied by some damage to the dyed fabric. Furthermore, it is often desirable, if not necessary, to segregate white clothes from colored clothes to minimize the deleterious effect of normal use levels of hypochlorite bleaches on colored fabrics and to prevent the transfer of dye from colored fabrics to white fabrics.

Those skilled in the art of detergent formulations have long been interested in a material that is stronger than the peroxide-type bleaches and would act in cold or tepid water, but yet is not as strong as the hypochlorite-type bleaches that have a deleterious effect on dyes and fabrics, and yet have a desirable bleaching property. In a copending application Ser. No. 838,279 filed Sept. 30, 1977 now U.S. Pat. No. 4,148,742 issued Apr. 10, 1979, a process was disclosed for washing soiled fabrics comprising contacting the fabrics with an aqueous detergent composition which includes a surfactant, a halogen-containing bleach and a bleach damage mitigating amount of trisodium imidodisulfate, tripotassium imidodisulfate or mixtures thereof. The combination of the hypochlorite and the trialkali metal salt of imidodisulfate provided a chloroimide bleach which is intermediate in strength between the hypochlorite and the peroxides, i.e., the intermediate bleach is strong enough to remove stains from the soiled fabric but yet is not so strong as to unduly damage the dyes and the fabric.

Although satisfactory results are achieved by the compositions in the process set forth in the copending application, those skilled in the art of detergent formulation are interested in a material useful as a bleach, intermediate in strength between the peroxides and the hypochlorites that could be formulated directly into a dry detergent formulation. It has been found that the disodium chloroimidodisulfate, which is formed when trisodium imidodisulfate is reacted with hypochlorite, in situ, in the washing process according to the teachings of the copending application is not stable as a solid since it rapidly loses the available chlorine. Furthermore, the literature reports that potassium chloroimidodisulfate is unstable as a solid (see, for example, F. Raschig, "Potassium Chloroimidodisulfonate", Z. Anorg. Allgem., Chem., 147, pp. 1–4 (1925)). Now, according to the present invention, a dipotassium chloroimidodisulfate is provided which is substantially stable in dry air at room temperature and normal atmospheric pressure, which can be prepared as a solid, and which is intermediate in strength as a bleach between perborates and hypochlorites.

SUMMARY OF THE INVENTION

These and other advantages are achieved by a substantially stable, crystalline dipotassium chloroimidodisulfate, which compound is substantially free of other alkali metals. The dipotassium chloroimidodisulfate is useful in a detergent composition consisting essentially of at least 5 percent by weight of a surfactant selected from the group consisting of anionic, nonionic, zwitterionic, ampholytic and amphoteric surfactants and mixtures thereof, and a sufficient amount of dipotassium chloroimidodisulfate to bleach stains on fabrics.

The term "substantially stable" as it is used in the specification and claims with respect to the dipotassium chloroimidodisulfate shall mean that the compound loses less than 5 percent of the available chlorine after thirty days at room temperature (about 21° C.) and less than 40 percent relative humidity.

Broadly described, the substantially stable, crystalline dipotassium chloroimidodisulfate of the present invention can be prepared by reacting diammonium imidodisulfate with potassium hydroxide to form tripotassium imidodisulfate with the evolution of ammonia. The tripotassium imidodisulfate is reacted with chlorine or potassium hypochlorite to form the dipotassium chloroimidodisulfate. The compound can be recovered from the aqueous solution as crystals.

Contrary to the teachings of the literature, it has been found that the crystalline compound of the present invention is substantially stable at room temperature. Although Applicants do not wish to be bound by any particular theory, it is believed that the presence of sodium ion prevents the crystalline dipotassium chloroimidodisulfate from being substantially stable, since it was found that a solid chloroimidodisulfate containing 90 atom percent potassium and 10 atom percent sodium lost about 80 percent of the available chlorine at room temperature at 25 percent relative humidity after 30 days. A solid chloroimidodisulfate containing 50 atom percent potassium and 50 atom percent sodium lost 40 percent of the available chlorine under the same conditions in only 15 days. A disodium chloroimidodisulfate (containing no potassium) when maintained as a solid at room temperature at 25 percent relative humidity lost greater than 80 percent of the available chlorine after only 5 days under these conditions and lost greater than 95 percent after 10 days. Hence, it is preferred that the dipotassium chloroimidodisulfate of the present invention is substantially free of other alkali metals, such as sodium, in Group Ia of the Periodic Table of the Elements. It is preferred that greater than 95 atom percent of the alkali metals is potassium in the dipotassium chloroimidodisulfate of the present invention, and even more preferred that greater than 99 atom percent of the alkali metal is potassium in the dipotassium chloroimidodisulfate of the present invention.

Surprisingly, even though solid dipotassium chloroimidodisulfate tends to lose available chlorine at high relative humidity, i.e., at greater than 70 percent relative humidity, at room temperature, it has been found that the compound is substantially stable in aqueous solutions maintained at pH 9 or higher, say about pH 10 to about pH 11, at room temperatures for several months. Although Applicants do not wish to be bound by any particular theory, it is believed that bisulfate is formed as one of the decomposition products when dipotassium chloroimidodisulfate loses its available chlorine, and the acid catalyzes subsequent decomposition of the chloroimidodisulfate. Hence, the use of buffering agents to maintain the pH of the solution between about pH 9.5 and about pH 11 is preferred, and a solution having a pH between about 9.8 and about 10.3 is especially preferred. Suitable buffering agents include magnesium oxide and hydroxide, calcium oxide and hydroxide, potassium carbonate, calcium carbonate, and the like. Mixtures of buffering agents can also be used. Other suitable buffering agents will occur to those skilled in the art in view of the present disclosure. Potassium carbonate is preferred.

Such buffering agents useful to maintain the pH of the aqueous solution of dipotassium chloroimidodisulfate between about pH 9.5 and about pH 11, when mixed with the crystalline dipotassium chloroimidodisulfate of the present invention, enhance the stability of the crystalline chloroimide. In addition, water insoluble buffering agents can also be used to enhance the stability of the crystalline chloroimide, such as zeolite-type materials like potassium aluminum silicate. Surprisingly, sodium aluminum silicate or sodium-potassium aluminum silicate provide satisfactory results as a buffering agent for the solid chloroimide, probably because the sodium ions are so tightly bound to the zeolite structure that they do not exchange with the potassium in the crystalline chloroimide.

The buffering agents can be mixed with the dipotassium chloroimidodisulfate by techniques known to the art. Mixtures can be prepared by conventional techniques such as blending the crystalline chloroimide and the powdered buffering agent, forming a slurry of the chloroimide and the buffering agent and recovering the mixture, or even forming a solution of the chloroimide and the buffering agent and recovering the solids from solution.

The amount of buffering agent to be mixed with the chloroimide to enhance the stability can vary within wide limits. At concentrations below about 2 weight percent, based on the weight of the crystalline chloroimide, little improvement in the stability of the chloroimide is seen, although there is some effect. Even though there is no theoretical upper limit to the amount of buffering agent that could be used, there does not seem to be an advantage to using more than 100 weight percent buffering agent, based on the weight of the crystalline chloroimide. It is preferred to use between about 5 and about 50 weight percent buffering agent, for example about 10 to about 25 weight percent, based on the weight of the solid chloroimide.

The amount of dipotassium chloroimidodisulfate effective to bleach stains from fabrics in an aqueous solution can vary within wide limits. As will occur to those skilled in the art in light of the present disclosure, the crystalline chloroimide can be incorporated into a detergent formulation, or it can be added separately to the water with or without other detergent ingredients. At a use level of about 750 ppm in the aqueous solution, equivalent to about 250 milliliters of sodium hypochlorite bleach solution in a home washer at the recommended use level, the chloroimide is about 90 percent as effective as the equivalent hypochlorite in removing stains, but causes substantially less damage to dyed fabric. As little as 10 ppm in the aqueous solution is beneficial for the removal of stains, although repeated treatments may be required to achieve the results desired by the user. The solubility limit of the dipotassium chloroimidodisulfate in the aqueous solution is a practical upper limit to the concentration to be used and a saturated solution could be used directly on fabrics to remove stubborn stains.

The solubility (as grams per 100 grams of water) can be determined by the following equation:

$$\text{Solubility (g/100 g } H_2O) = 6.42 + (0.47X^\circ \text{ C.})$$

Thus, at 25° C. the solubility of dipotassium chloroimidodisulfate in water is about 182 grams per liter.

The compound of the present invention can be formulated into a powdered detergent composition according to well understood and conventional detergent formulation practice, provided that substantially all of the free water is removed from the composition upon formulation. It is only necessary that there is a sufficient amount of the dipotassium chloroimidodisulfate to bleach stains on the fabric to enhance the cleaning performance of the detergent formulation. However, as noted above, an aqueous solution of the dipotassium chloroimidodisulfate is more stable at pH 9.5 to about pH 11, and it is preferred that when the powdered detergent formulation is added to water, the resulting solution has a pH in the range of about pH 9.5 to about 11, say about pH 9.8 to about pH 10.3.

In addition to increased stability the chloroimide of the present invention is most effective as a bleach in solution within these pH ranges. At lower pH the bleach is too weak, and at higher pH the bleach approaches the strength of hypochlorite.

This is normally not a problem since most powdered detergent formulations to clean fabrics form an aqueous solution within this pH range. To insure that the powdered detergent formulation provides an aqueous solution in this pH range at normal use levels, a buffering agent can be added to the formulation to obtain the maximum benefit of the chloroimide as a bleaching agent.

The amount of dipotassium chloroimidodisulfate for use in a detergent composition can vary within wide limits. It has been found that when the detergent composition contains less than about 1 weight percent, based on the weight of the detergent composition, of dipotassium chloroimidodisulfate of the present invention that repeated washings would be required in order to remove stains, such as grape juice, tea, red wine and the like. Hence, it is preferred to use greater than 5 weight percent dipotassium chloroimidodisulfate in the detergent composition, say up to about 30 percent. Clearly, higher concentrations could be used but only at the expense of the presence of surfactants, builders or other detergent ingredients.

Although satisfactory bleaching results are achieved by the detergent composition of the present invention when a builder is not present, it is preferred to use at least 5 percent by weight of a builder to sequester calcium and magnesium ions. The detergent composition should preferably contain from about 5 percent to about 25 percent or even higher, say up to 60 percent by weight, builder. Only one detergency builder can be used or a combination of detergency builders can be used. By way of example, builders which can be employed either alone or in combination with other builders in accordance with this invention include either water insoluble materials, such as sodium alumino-silicates, commonly known as zeolites, or water soluble inorganic builder salts such as alkali metal polyphosphates, i.e., the tripolyphosphates and pyrophosphates, alkali metal carbonates, borates, bicarbonates and silicates, or water soluble organic builders, including amino polycarboxylic acids and salts, such as alkali metal nitrilotriacetates, cycloalkane polycarboxylic acids and salts, ether polycarboxylates, alkyl polycarboxylates, epoxy polycarboxylates, tetrahydrofuran polycarboxylates, such as 1,2,3,4 or 2,2,5,5 tetrahydrofuran tetracarboxylates, benzene polycarboxylates, oxidized starches, amino(trimethylene phosphonic acid) salts, diphosphonic acid salts (e.g., the sodium salts of methylene diphosphonic acid or 1-hydroxy ethylidene 1,1-dimethylene phosphonic acid), polymeric polycarboxylates and the like.

The quantity of surfactant in the detergent compositions of this invention will depend on the surfactant chosen and the intended end use. In general, the compositions will contain from 5 percent to 50 percent surfactant by weight, although as much as 95 percent surfactant may be employed if desired. For example, general laundry powder formulations normally contain 5 percent to 50 percent, preferably 10 percent to 25 percent surfactant by weight. The weight ratio of surfactant to builder will generally be in the range of from 1:12 to 2:1.

Any number of water soluble anionic, nonionic, zwitterionic or amphoteric surfactants known to those skilled in the art can be used in the detergent compositions of the present invention. A summary of surfactants, their properties and uses, including surfactant mixtures, can be found in "Surface Active Agents, Their Chemistry and Technology", by A. M. Schwartz and J. W. Perry, Interscience Publishers, Inc., New York, New York (1949).

Examples of suitable anionic surfactants include soaps such as the salts of fatty acids containing about 9 to 20 carbon atoms, e.g., salts of fatty acids derived from coconut oil and tallow; alkylbenzene sulfonates—particularly linear alkylbenzene sulfonates in which the alkyl group contains from 10 to 16 carbon atoms; alcohol sulfates; ethoxylated alcohol sulfates; hydroxy alkyl sulfonates; alkyl sulfates and sulfonates; monoglyceride sulfates; acid condensates of fatty acid chlorides with hydroxy alkyl sulfonates; and the like.

Examples of suitable nonionic surfactants include alkylene oxide (e.g., ethylene oxide) condensates of mono- and polyhydroxy alcohols, alkyl phenols, sugar derivatives such as sucrose monopalmitate; long chain tertiary phosphine oxides, dialkyl sulfoxides; and the like.

Examples of suitable zwitterionic surfactants include derivatives of aliphatic quaternary ammonium compounds such as 3-(N,N-dimethyl-N-hexadecylammonio) propane-1-sulfonate and 3-(N,N-dimethyl-N-hexadecylammonio)-2-hydroxy propane-1-sulfonate.

Examples of suitable amphoteric surfactants include betains, sulfobetains and fatty acid imidazole carboxylates and sulfonates.

Optimum quantities of surfactant, builder and bleaching salts of the present invention can be established by routine testing in accordance with conventional detergent formulation practice.

DESCRIPTION OF THE PREFERRED EMBODIMENTS

This invention is illustrated by, but not limited to, the following Examples wherein all percentages are by weight unless otherwise noted.

EXAMPLE I

Using the procedure of P. Baumgarten, Ber., 6913, 2929–2937 (1936), diammonium imidodisulfate was prepared by adding 114 grams (1.0 mol) of ammonium sulfamate to 97 grams (1.0 mole) of sulfamic acid in a one liter beaker. The mixture was heated on a hot plate with constant mixing. At about 130° C. a stirrable slurry was obtained, and at about 155° C. an exothermic reaction began, forming a solid. When the solid cooled, it was dissolved in about 375 grams of 45 percent potassium hydroxide. Water was added to bring the total volume to 800 milliliters. The resulting solution was filtered and then heated under vacuum to expel ammonia. The solution was cooled and concentrated hydrochloric acid was carefully added to adjust the mixture to pH 7.5. The resulting precipitate was filtered yielding about 150 grams of dipotassium imidodisulfate.

About 100 grams of the dipotassium salt and 51 g. of 45 percent potassium hydroxide were added to 500 grams of water. Chlorine gas was added to the solution until it reached pH 7.5. Potassium hydroxide was added to the solution to adjust it to pH 8.5. The solution was filtered and evaporated on a rotary evaporator until the solution became cloudy with precipitated crystals. The solution was cooled and the precipitate was recovered by filtration. The precipitate was dried overnight in a stream of dry air.

Analysis of a portion of the precipitate confirmed that the precipitate was $Cl.N(SO_3K)_2$. A potassium iodide-thiosulfate titration showed that the product contained about 23.8 percent available chlorine. Analysis by X-ray diffraction using a Phillips scanning X-ray diffractometer using CuK$\alpha$ radiation showed the following major spacings: 4.29; 4.39; 4.57; 4.63; 4.70; 5.73; 6.08; 6.45; 7.25; and 7.80 A.

EXAMPLE II

The dipotassium chloroimidodisulfate from Example I was used in a series of experiments to compare the bleaching effectiveness of the chlorinated salt with sodium hypochlorite and sodium perborate. Two common stains, tea and grape juice, were chosen to test the bleach efficiency. To test damage, two fabrics with bleach sensitive dyes, i.e., blue jean and a brown cotton, were chosen to give dyes and stains with similar colors (blue and brown). The dye damage tests were run for three cycles to give the data more precision.

To perform the tests, water containing 100 ppm hardness with a calcium to magnesium ratio of 3:2 was used with 1500 ppm of a typical commercial detergent. The detergent contained linear alkylbenzene sulfonate as the surfactant and sodium tripolyphosphate as a builder along with minor amounts of other detergent ingredients. The wash water was at 120° F. (about 50° C.) and the cycle time was ten minutes. The detergent solution had a pH of about 10.

After washing, the swatches were read on a Gardner XL-23 Colorimeter. The YXZ values (percent reflectance of green, red and blue light, respectively) were read before and after washing. Since the dyes and stains were consistent, the ratio of initial values was similar. This allowed the final YXZ values to be compared directly. The results, presented in Table 1, are the averages for all tests and have been normalized to permit ready comparison between sodium hypochlorite, sodium perborate and dipotassium chloroimidodisulfate.

TABLE 1

| Bleach | Performance Relative To NaOCl: Stain Removal | Dye Damage |
|---|---|---|
| None - detergent only | 0 | 0 |
| NaOCl (200 ppm Cl) | 100 | 100 |
| Cl . $N(SO_3K_2)_2$ (200 ppm) | 75 | 20 |
| Perborate (500 ppm) | 15 | 5 |

EXAMPLE III

A portion of the dipotassium chloroimidodisulfate of Example I was maintained at room temperature (~24° C.) and a relative humidity of about 30 percent for 30 days. Thereafter, the portion was analyzed for available chlorine. The results indicated that less than 3 percent of the available chlorine had been lost over this period of time.

EXAMPLE IV the stability of the dipotassium chloroimidodisulfate of Example I was measured at higher relative humidities and at higher temperature by dry mixing various additives with the chlorinated salt and slurrying additives with the chlorinated salt, and maintaining portions at 23° C. and 75 percent relative humidity, and at 50° C. and about 15 percent relative humidity. After 24 hours, the portions were analyzed for the available chlorine lost during the tests. The results are presented in Table 2.

TABLE 2

| Additive: Identity | Additive: Wt. % | Method of Mixing | Cl Loss (%) During Prep. | Cl Loss (%) 23° C. | Cl Loss (%) 50° C. |
|---|---|---|---|---|---|
| None | — | — | — | 99.8 | 42 |
| $K_2CO_3$ | 10 | A | — | 72 | 53 |
| $K_2CO_3$ | 33 | B | 24 | 0 | 9 |
| $Na_2CO_3$ | 10 | A | — | 100 | C |
| $Li_2CO_3$ | 10 | A | — | 98 | 45 |
| $CaCO_3$ | 10 | A | — | 77 | 57 |
| $CaCO_3$ | 26 | B | 19 | 0 | 19 |
| CaO | 10 | A | — | 54 | C |
| CaO | 16 | B | 41 | 4 | 58 |
| MgO | 10 | A | — | 46 | C |
| MgO | 12 | B | 16 | 0 | 7 |

A = dry mix
B = slurrying and evaporating to dryness
C = not measured

Although the invention has been described in terms of specified embodiments which are set forth in considerable detail, it should be understood that this is by way of illustration only and that the invention is not necessarily limited thereto since alternative embodiments and operating techniques will become apparent to those skilled in the art in view of the disclosure. As an example, the detergent composition of the present invention may contain fillers, such as sodium sulfate, and minor amounts of dyes, optical brighteners, soil antiredeposition agents, perfumes and the like. Accordingly, modifications are contemplated which can be made without departing from the spirit of the described invention.

What is claimed is:

1. A solid detergent formulation comprising at least 5 percent by weight of a surfactant selected from the group consisting of anionic, nonionic, zwitterionic, ampholytic and amphoteric surfactants and mixtures thereof, and a sufficient amount of substantially stable, crystalline dipotassium chloroimidodisulfate to bleach stains on fabrics in an aqueous solution.

2. A detergent formulation of claim 1 wherein the amount of dipotassium chloroimidodisulfate is between about 1 and about 30 weight percent, based on the weight of the detergent formulation.

3. A detergent formulation of claim 1 or 2 wherein the surfactant is alkylbenzene sulfonate.

* * * * *